US006076221A

United States Patent [19]

Bradshaw

[11] Patent Number: 6,076,221

[45] Date of Patent: Jun. 20, 2000

[54] ADJUSTABLE GROUT CLEANING BRUSH

[76] Inventor: Robert John Bradshaw, 3406 Waterlily Ct., No. 214, Palm Beach Gardens, Fla. 33410

[21] Appl. No.: 09/154,936

[22] Filed: Sep. 17, 1998

[51] Int. Cl.[7] ..... A46B 7/00; A46B 5/00; A46B 15/00

[52] U.S. Cl. ..... 15/160; 15/172; 15/176.1; 15/176.6; 15/201; 15/202

[58] Field of Search ..... 15/160, 172, 166, 15/176.1–176.6, 201, 202

[56] References Cited

U.S. PATENT DOCUMENTS

| | | | |
|---|---|---|---|
| 2,675,573 | 4/1954 | Strong | 15/176.4 |
| 3,239,866 | 3/1966 | Czerniawski | 15/176.4 |
| 4,255,827 | 3/1981 | Palazzo | 15/176.3 X |
| 4,575,894 | 3/1986 | Stevens et al. | 15/176.5 X |
| 5,319,824 | 6/1994 | Cook, III | 15/172 X |
| 5,412,829 | 5/1995 | Hefner | 15/160 X |
| 5,581,838 | 12/1996 | Rocco | 15/176.1 X |
| 5,903,950 | 5/1999 | Lavin | 15/176.5 X |

FOREIGN PATENT DOCUMENTS

| | | | |
|---|---|---|---|
| 77869 | 5/1983 | European Pat. Off. | 15/176.1 |
| 1196596 | 11/1959 | France | 15/176.1 |
| 551428 | 11/1956 | Italy | 15/172 |

*Primary Examiner*—Mark Spisich
*Attorney, Agent, or Firm*—McHale & Slavin

[57] ABSTRACT

An adjustable brush for cleaning grout includes a group of brush mounting constructions slidably disposed on a rigid support track. Each mounting construction is movable, yet selectively held in place along the longitudinal axis of the support track. A brush assembly is removably attached to each brush mounting construction. Each brush assembly includes bristles secured within a bristle holding member, and the brush assemblies are selectively held in place during use.

14 Claims, 9 Drawing Sheets

Transparent view of rail illustrating brush mount construction and brush assemblies Bottom view with one brush to the side Bottom view with one brush to the side Bottom view with one brush to the side Close up of brush attachment mount truck secured with spring and ball bearings.

Close up of bristle mount/brush removed from attachment mount/truck

Close up of bristle mount/brush inserted into brush mounting construction

ADJUSTABLE GROUT CLEANING BRUSH

FIELD OF THE INVENTION

This invention is directed to adjustable brushes and, in particular, to a grout cleaning brush having multiple brush mounts and replaceable bristles.

BACKGROUND OF THE INVENTION

Tiled surfaces provide durability, a wide range of appearances, and an assortment of textures suited for many applications. A tiled surface commonly comprises a matrix of pre-cut pieces that have been permanently secured to an underlying support surface. The individual pieces are spaced apart and the spacing is typically filled with grout. The grout gives stability to the matrix of tiles and helps keep the individual pieces from working loose over time.

Although grout has structural importance, grout may also be used to add visual impact to a tiled surface. Grout comes in many colors and can contrast with, or otherwise complement, the tiles themselves. Grout not only makes tiled surfaces more durable, it makes them more attractive, as well.

Unfortunately, although tiled surfaces can be durable and attractive, they can also be difficult to keep clean. While tile pieces may be cleaned with broad, sweeping motions, grouted areas are usually recessed and not cleaned so easily. Whereas tile pieces may be cleaned with a mop or sponge, grout cleaning typically requires the use of a scrub brush and the application of increased pressure. As a result, cleaning the grout in a large tiled surface can be a difficult, time-consuming job. Moreover, cleaning the grout in a tiled floor can lead to back or knee injuries, due to the stooped-over or kneeling postures that are commonly adopted.

Although special cleaners exist that attack the type of dirt or mildew that accumulates on grout, these cleaners do not change the terrain of tiled surface: the grouted surfaces remain recessed. The existence of specialized cleaners may make dirt or mildew easier to remove, but actual removal still requires methodical scrubbing.

Stiff-bristled scrubbing brushes cooperate with grout cleaning chemicals to aid in the dirt and mildew removal process. However, tiled surfaces that span large areas are difficult to clean even with these brushes. This is especially true when painted or otherwise-decorated tiles are used. These ornate finishes are often delicate and require extra care to avoid scratches or premature wear.

The grout cleaning process is made somewhat easier by specialized brushes shaped to fit into individual lines of grout. To be effective, however, the heads of these brushes must be appropriately sized for the grout lines to be cleaned; a brush head that is too wide will not effectively clean narrow lines of grout. Even when an appropriately-sized brush is chosen, cleaning the multitude of grout lines associated with most tiled surfaces is a daunting task. The lines of grout must still be cleaned one at a time.

Simply adding multiple brush heads to an existing brush does not adequately address the problem of cleaning several lines of grout simultaneously. Since the distance between grout lines is based upon tile size, a unique brush would be required for each type of tile available. Even within a given tiled surface, rectangular pieces would need a second multiple-head brush to clean height-aligned and width-aligned grout lines effectively. The possibility for surfaces that have both broad tiles and narrow tiles makes brush requirements even more complicated.

Furthermore, proper grout line width is a function of the type of surface to be tiled next. For example, tiled walls found in most bathrooms typically use grout lines that are narrower than most tiled floors. As a result, the appropriate number of bristles can also vary from one surface to the next.

What is needed is a brush that includes advantages of the known devices, while addressing the shortcomings they exhibit. The brush should have multiple heads to clean several lines of grout simultaneously. The spacing between the brush heads should be adjustable to accommodate different tile sizes within a given tiled surface. The brush should include removable bristles that may be replaced as needed, due to wear, and the individual brush assemblies should be customizable to clean grout lines of different widths. The brush should also be mountable on an extension pole to allow floor-tile-cleaning with proper posture.

SUMMARY OF THE INVENTION

The instant invention is an adjustable grout cleaning brush. The invention includes several brush mounting constructions that are slidably disposed on a rigid support track. The brush mounting constructions are selectively held in place by a positioning means that allows user-selected placement of each brush mounting construction anywhere along the support track. The positioning means includes spring-biased members that frictionally engage a channel or recess within a main panel of the support track. The track main panel may include several recesses, with each recess corresponding to a preferred location along the longitudinal axis of the support track.

Each brush mounting construction includes a removable brush assembly. The brush assemblies each include a bristle holding member, and groups of bristles are anchored within the holding members. Each brush assembly engages an associated brush mounting construction in tongue-and-groove fashion. In this manner, individual brush assemblies may be removed from the corresponding brush mounting constructions.

Each brush assembly is selectively secured to the corresponding brush mounting construction via a brush assembly locking means. Each locking means includes a spring-biased member that engages a positioning recess disposed within a contact surface of the bristle holding member. With this arrangement, the brush assemblies may be removed as needed, but will remain in place until such removal is desired.

Thus, it is an objective of the instant invention to provide an adjustable grout cleaning brush that has multiple brush heads to clean several lines of grout simultaneously.

An additional objective of the instant invention is to provide an adjustable grout cleaning brush that allows mixed spacing between brush heads to accommodate different tile sizes within a given tiled surface, even within a given tiled surface.

A still further objective of the instant invention is to provide an adjustable grout cleaning brush that includes removable bristles which may be replaced as needed.

Yet another objective of the instant invention is to provide an adjustable grout cleaning brush that is customizable to clean grout lines of different widths.

An additional objective of the instant invention is to provide an adjustable grout cleaning brush that cooperates with an extension pole, as needed, to allow floor-tile cleaning with proper posture.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects a nd features thereof.

DETAILED DESCRIPTION OF THE PREFERRED EMBODIMENT

Figure 1:
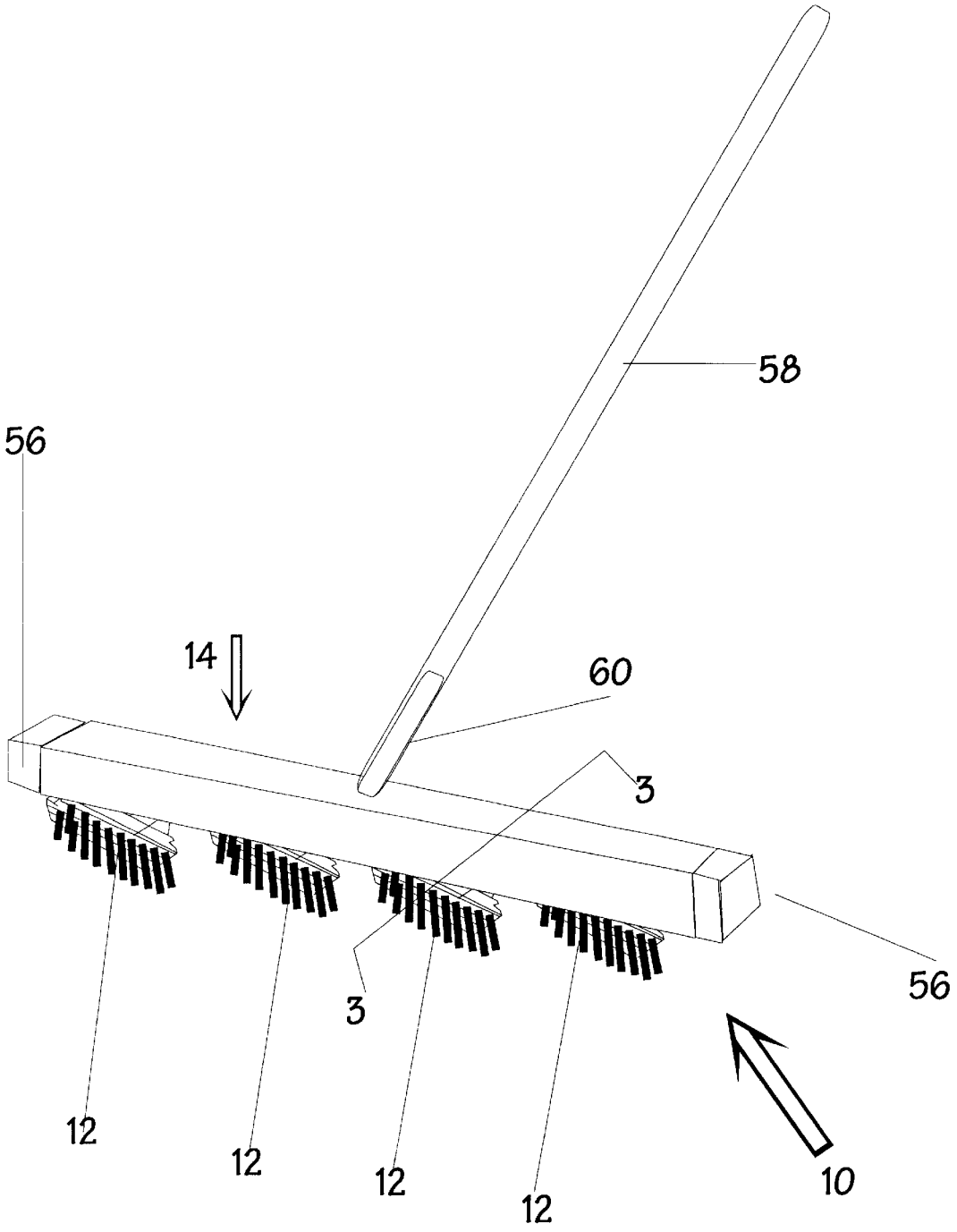
FIG. 1 is a pictorial view of the adjustable grout brush of the present invention, shown attached to an extension pole.
Figure 1A:
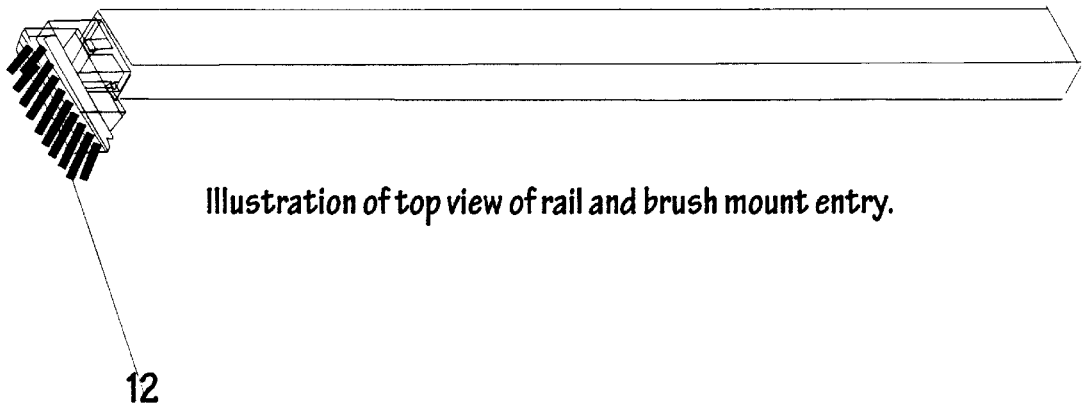
Figure 1A:
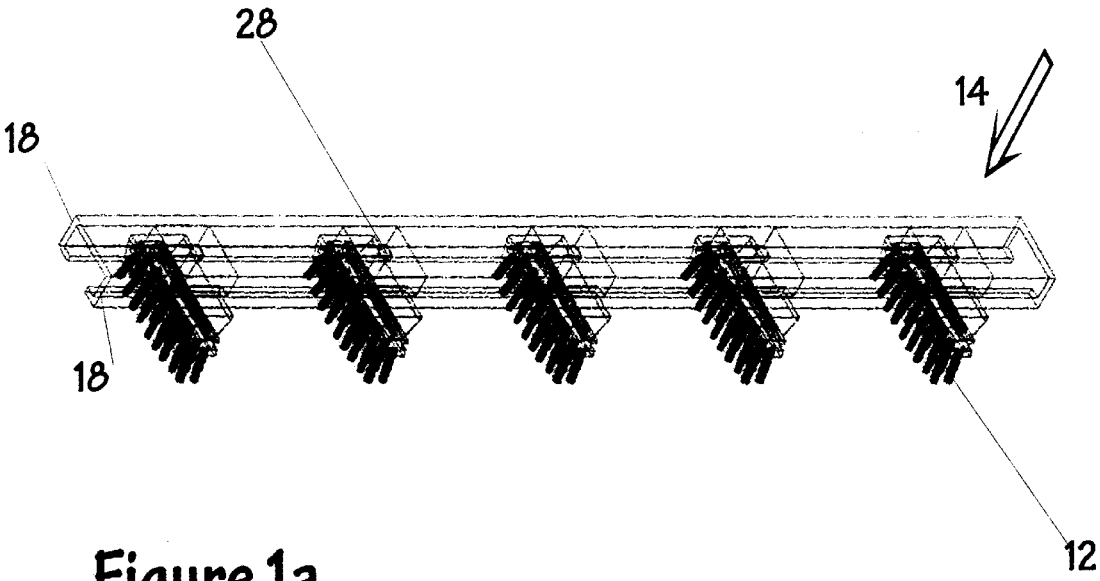

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Now with reference to FIG. 1, the adjustable brush 10 of the current invention is shown. By way of overview, the adjustable brush 10 includes a plurality of identical brush mounting constructions 12 slidably mounted on a support track 14. Each brush mounting construction 12 includes a brush assembly 16 removably attached thereto. The brush assemblies 16 are secured onto the brush mounting constructions 12 by an integrated locking means 15, and the brush mounting constructions are maintained in user-selected locations along the support track by a mounting construction positioning means 17. The brush 10 will now be discussed in detail.

Figure 2A:
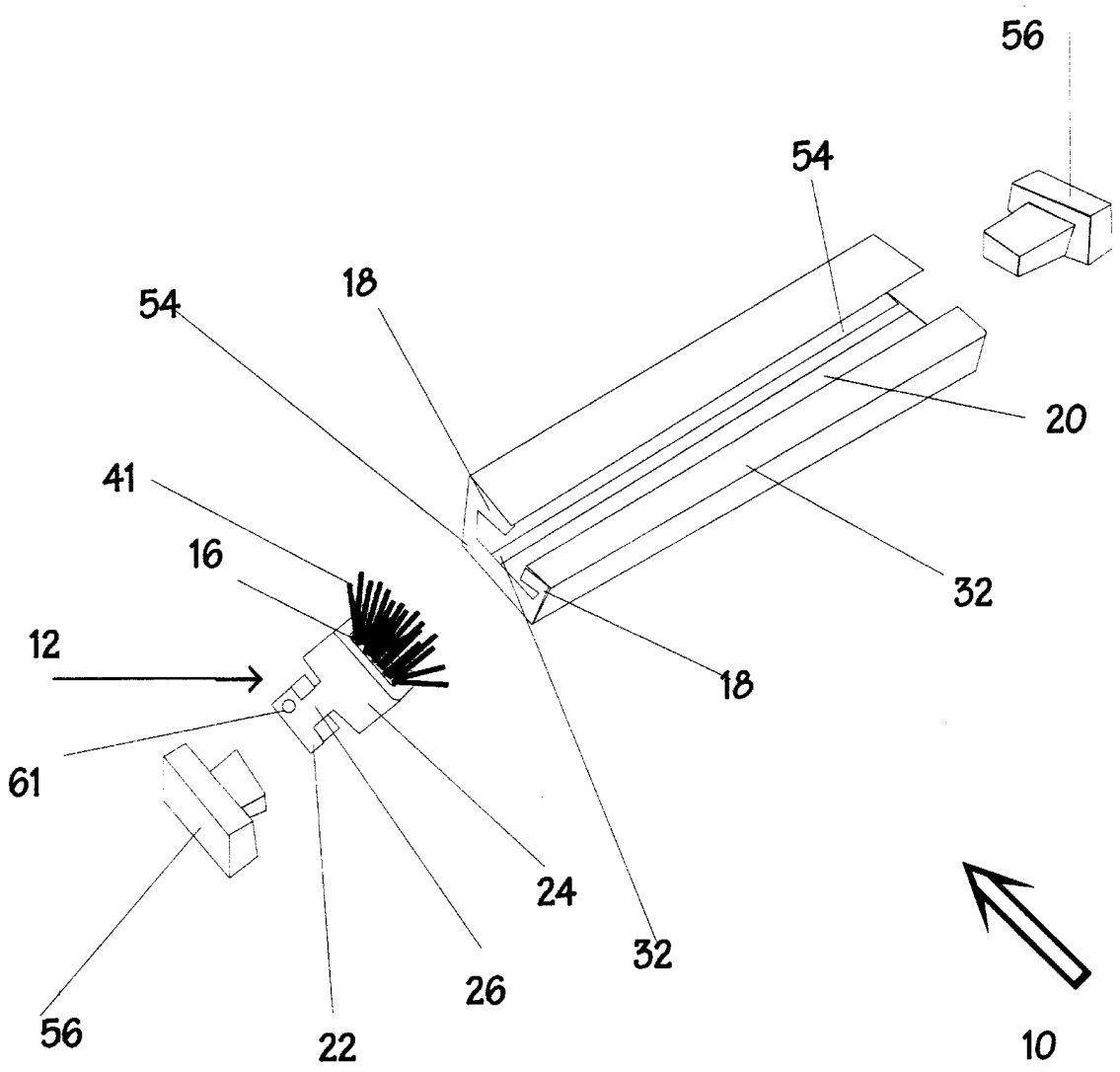
FIG. 2*a* is a partial bottom exploded view of the brush shown in FIG. 1, including one brush mounting construction and two end caps removed.
Figure 2B:
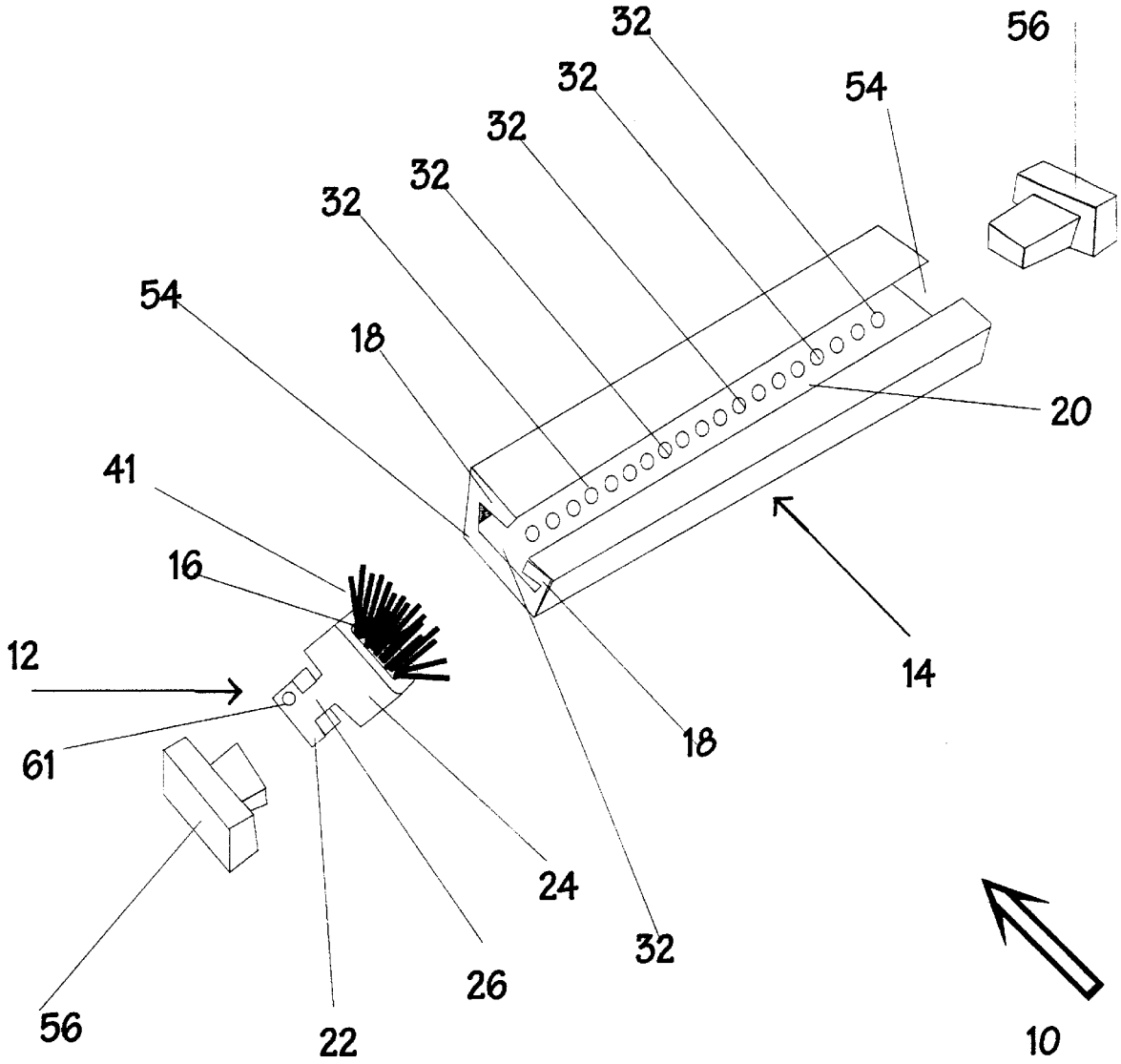
FIG. 2*b* is an alternate embodiment of the brush shown in FIG. 2*a;*
Figure 2C:
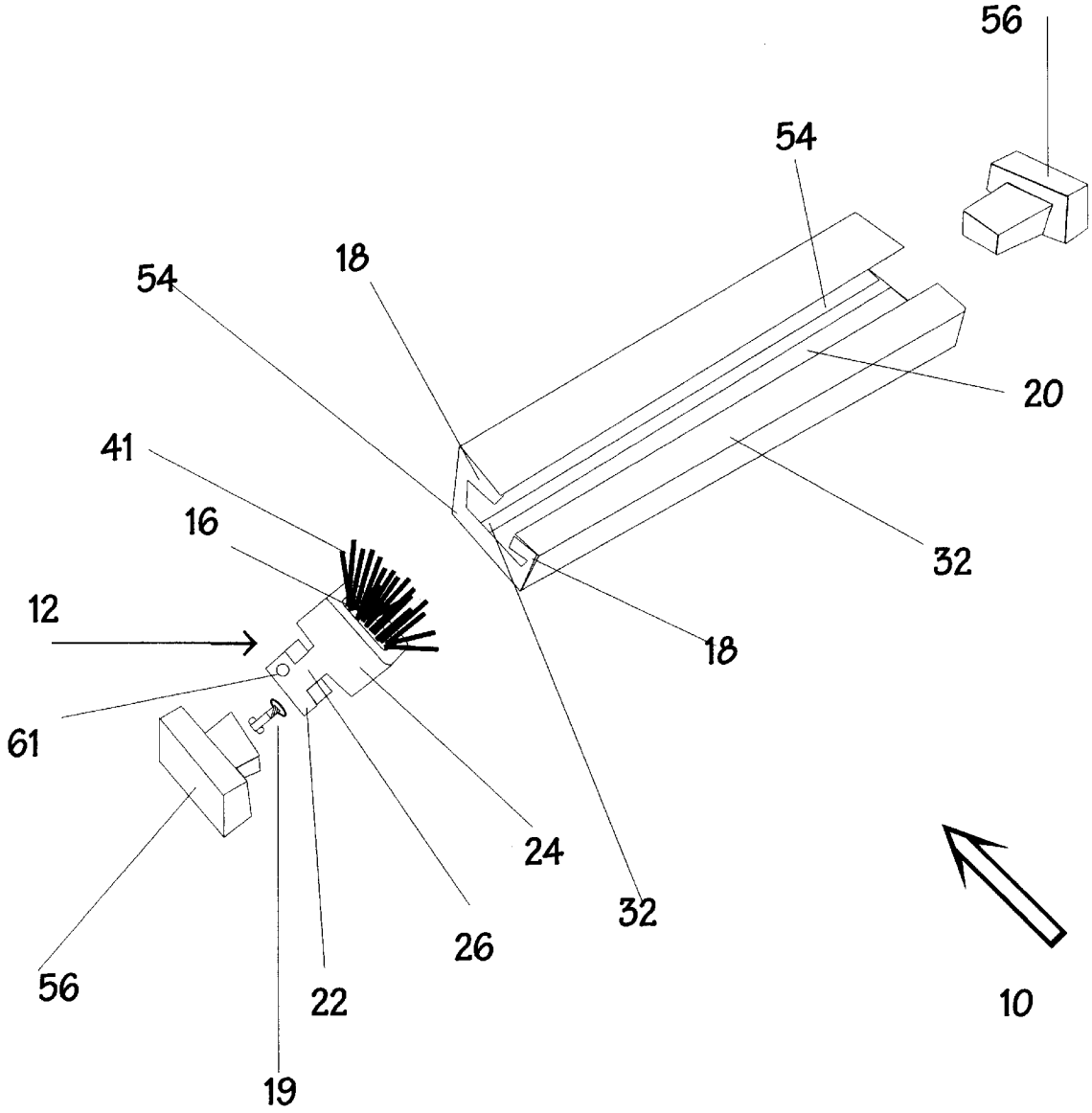
FIG. 2*c* is an alternate embodiment of the brush shown in FIG. 2*a;*

With additional reference to FIGS. 2A, 2B, and 2C, the support track 14 is essentially an elongated rectangular member having a C-shaped cross section. The support track 14 is characterized by a pair of spaced-apart, L-shaped flanges 18 that extend orthogonally from a support track main panel 20. The support track 14 may be made from a variety of materials, including, but not limited to, aluminum, stainless steel, titanium, wood, graphite, or plastic. Other materials may be used as necessary.

In keeping with the objectives of the present invention, the grout cleaning brush 10 includes a group of brush mounting constructions 12. In a preferred embodiment the brush 10 includes four brush mounting constructions 12. However, the brush 10 may include more, or fewer, brush mounting constructions 12, as needed. The structure and operation of each of these mounting constructions 12 is identical. Therefore, where only one brush mounting construction 12 is described, this description applies to each of the constructions.

Figure 3:
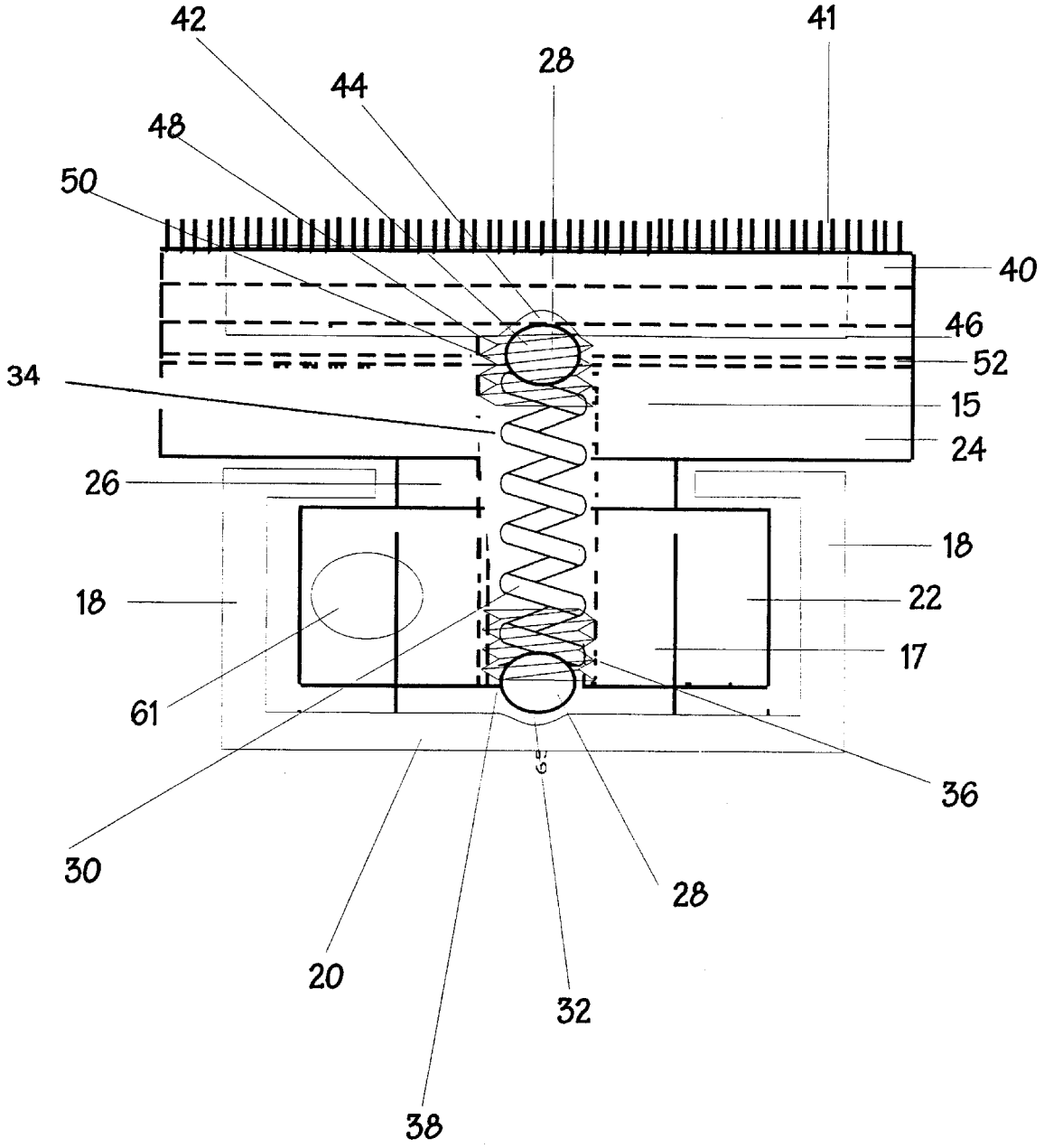
FIG. 3 is a cross-section view of the brush shown in FIG. 1, taken along line 3—3 in FIG. 1.

The brush mounting construction 12, as can be more clearly seen in FIG. 3, is a single-piece unit having a head 22 spaced apart from a foot 24 by an integral neck portion 26 extending therebetween. As seen in FIG. 3, the head 22, neck 26, and foot 24 of each brush mounting construction 12 is shaped so that the mounting construction slidably engages the support track 14. More particularly, when the mounting construction 12 is in place, the mounting construction head 22 is bounded by the track main panel 20 and L-shaped flanges 18. Additionally, the mounting construction foot 24 rests against the L-shaped flanges 18. The mounting construction neck 26, as mentioned above, extends between the head 22 and foot 24. With this arrangement, the mounting construction 12 will slide along the longitudinal axis of the support track 14, but other relative motion between the mounting construction and support track is prevented.

As mentioned above, the brush mounting construction 12 is adjustably held in place along the support track 14, in a user-selected location, by a positioning means 17. With continued reference to FIGS. 2A and 2B, the mounting construction positioning means 17 includes a recess-engaging member 28 that cooperates with a biasing member 30 to frictionally engage a channel or groove 32 cut into the support track main panel 20.

In a preferred embodiment, as seen in FIG. 2A, the channel 32 extends the length of the main panel 20 and is parallel to the longitudinal axis of main panel 20. The biasing member 30 is a compressed spring located inside a spring chamber 34, seen most clearly in FIG. 3. The spring chamber 34 extends within the brush mounting construction 12 and spans spanning between the outer surfaces of the neck 26 and head 22. A first retention seat 36 is threadably disposed at a first end 38 of the spring chamber 34. As seen in FIG. 3, the retention seat 36 allows a portion of the recess-engaging member 28 to extend through the outer surface of the mounting construction head 22, but prevents the recess-engaging member from completely exiting the spring chamber 34. In this embodiment, the recess-engaging member 28 is a ball bearing. With this arrangement, the biasing spring 30 forces a portion of the recess-engaging member 28 into frictional engagement with the main panel channel 32. Although the biasing member 30 has been described as a spring, any number of elastic structures, including cantilevered leaves, may be used if desired. Similarly, although the recess-engaging member 28 has been described as a ball bearing, other structures may suffice. The recess engaging member need not be spherical and may even be formed integral with the biasing member 30.

In an alternate embodiment, as seen in FIG. 2B, the channel 32 may be divided into discrete cavities 38 sized to accommodate the portion of the recess-engaging member 28 that extends beyond the mounting construction head 22. The discrete cavities 32 provide particularly defined locations at which the mounting construction 12 may be stopped along the longitudinal axis of the support track 14. The cavities 38 need not be adjacent each other; they may be spaced apart. The spring-loaded nature of the positioning means 17 allows the recess-engaging member to follow the contours of the main panel 20, as the mounting construction 12 slides from one position to another. Although the biasing member 30 has been described as a spring, any number of elastic structures, including cantilevered leaves, may be used if desired. Although the recess-engaging member 28 may be a ball bearing, other structures may suffice. The recess engaging member need not be spherical and may even be formed integral with the biasing member 30.

As shown in FIG. 2C, the channel 32 may also be cut through the support track main panel 20. With this arrangement, the brush mounting constructions 12 are each held in place by a wing nut 19 that passes through the channel 32. Appropriate washers, not shown, may be used in conjunction with the wing nut 19 as needed. Tightening the wing nuts 19 selectively secures the associated brush mounting constructions 12 at user-selected positions along the support track 14.

Figure 4A:
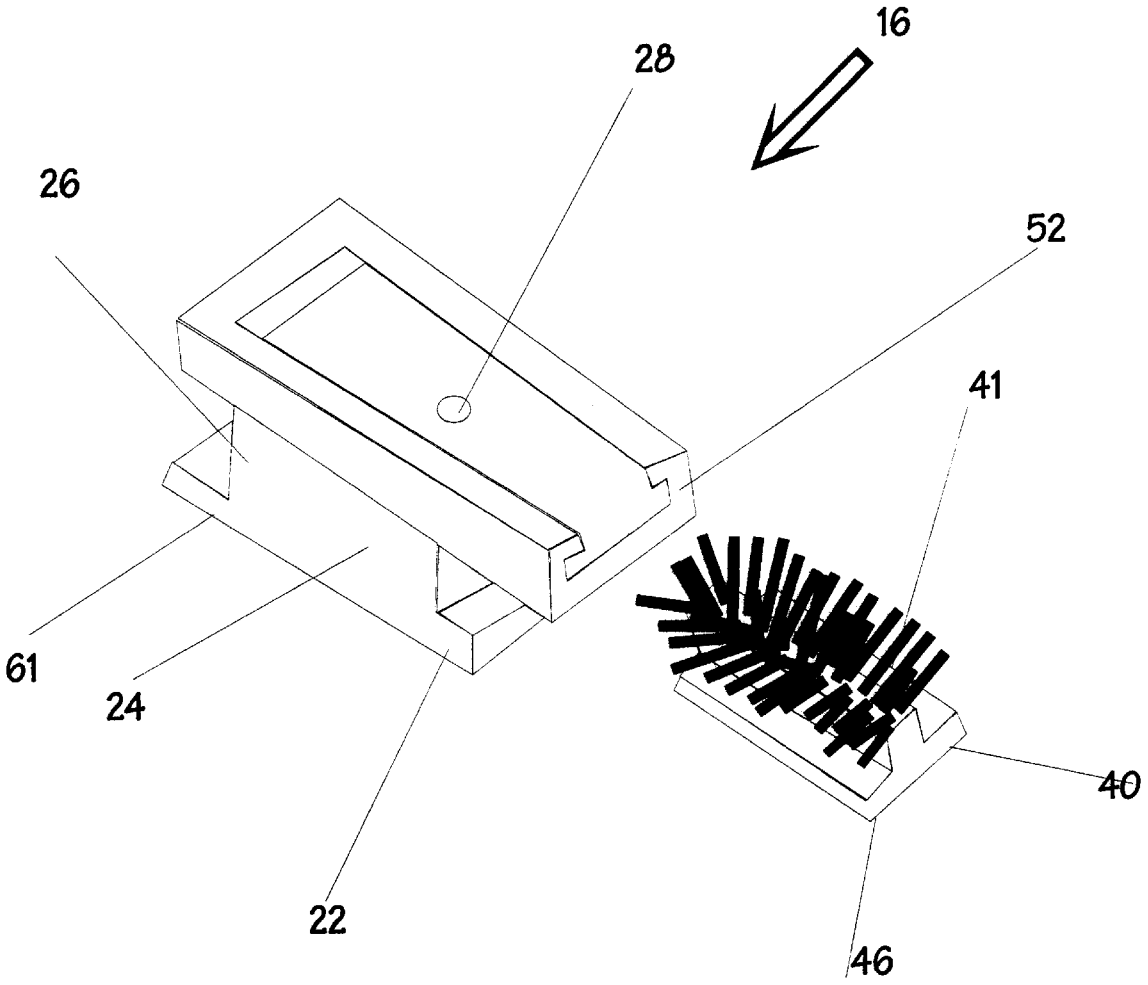
FIG. 4*a* is a close-up pictorial view of a brush mounting construction according to the present invention, with a corresponding brush assembly removed.
Figure 4B:
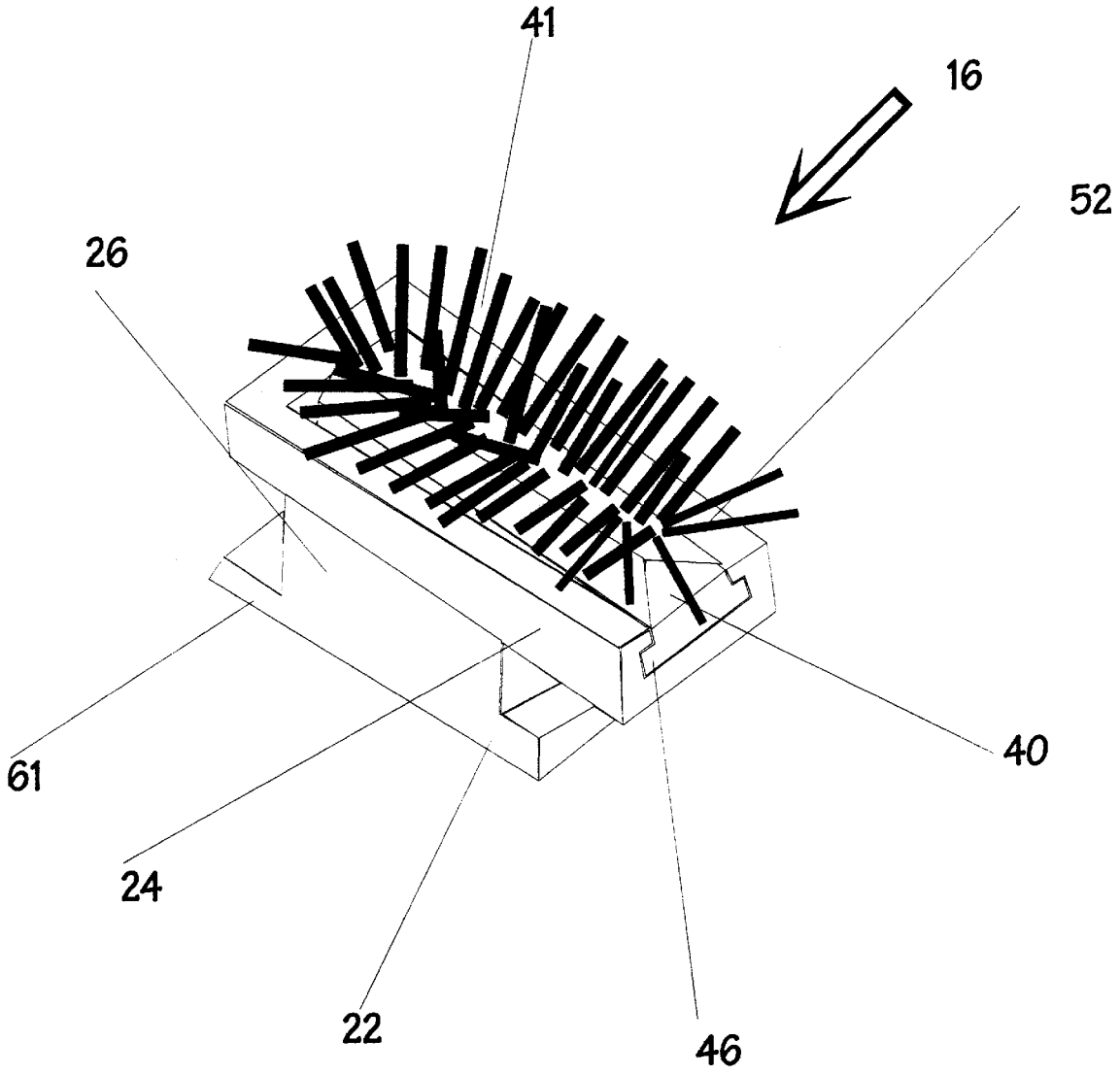
FIG. 4*b* is a close-up pictorial view of a brush mounting construction according to the present invention, with a corresponding brush assembly inserted.

With reference to FIGS. 4*a* and 4*b*, the head 22 of each brush mounting construction 12 is shaped to hold a replaceable brush assembly 16. The brush assembly 16 essentially comprises a bristle holding member 40 and several collections of bristles 41 anchored therein. The bristle holding member 40 slides into the mounting construction head 22 and is secured by a tongue-and-groove arrangement. As mentioned above, locking means 15 holds the brush assembly 16 firmly within the mounting construction head 22.

With continued reference to FIG. 4*a*, the locking means 15 includes a recess-engaging member 42 that is biased to engage a positioning recess 44 cut into the contact surface 46 of the bristle holding member 40. More particularly, the recesses-engaging member 42 is a ball bearing that rests against a second end 48 of the previously discussed biasing member 30. As can be seen in FIG. 4*a*, the brush assembly recess-engaging member 42 is located within the spring chamber 34, and a second retention seat 50 prevents exit of the recess-engaging member. The second retention seat 50 does, however, allow a portion of the brush assembly recess-engaging member 42 to extend through the contact surface 52 of the mounting construction head 22.

Sliding the bristle holding member 40 into a fully-seated position aligns the recess engaging member 42 with the positioning recess 44 cut into the contact surface 46 of the bristle holding member. When the bristle holding member is fully seated, biasing member 30 forces a portion of the recess engaging member 42 into the positioning recess 44, selectively locking the bristle holding member 40, and the associated bristles 41, onto the mounting construction head 22. In a preferred embodiment, the bristles 41 are made of stiff nylon. However, bristles 41 of other material, such as wire or hair, may also be used. Bristle 41 density and amount may be varied to suit grout lines of any width.

The free ends 54 of the support track 14 include end caps or plugs 56 that prevent accidental removal of the mounting constructions 12. The mounting constructions 12 may not be removed when the end caps 56 are in place, but the end caps are removable. With one or both of the end caps 56 removed, the individual mounting constructions 12 may be slid out from within the support track 14. Similarly, additional mounting constructions 12 may be added while the end caps are removed.

As seen in FIG. 1, the brush 10 of the present invention may be attached to a handling pole 58 via a linking member 60 that extends from the support track 14. Th e angle between the handling pole 58 and the support track may be fixed, or the linking member 60 may allow adjustable positioning of the handling pole.

Figure 5:
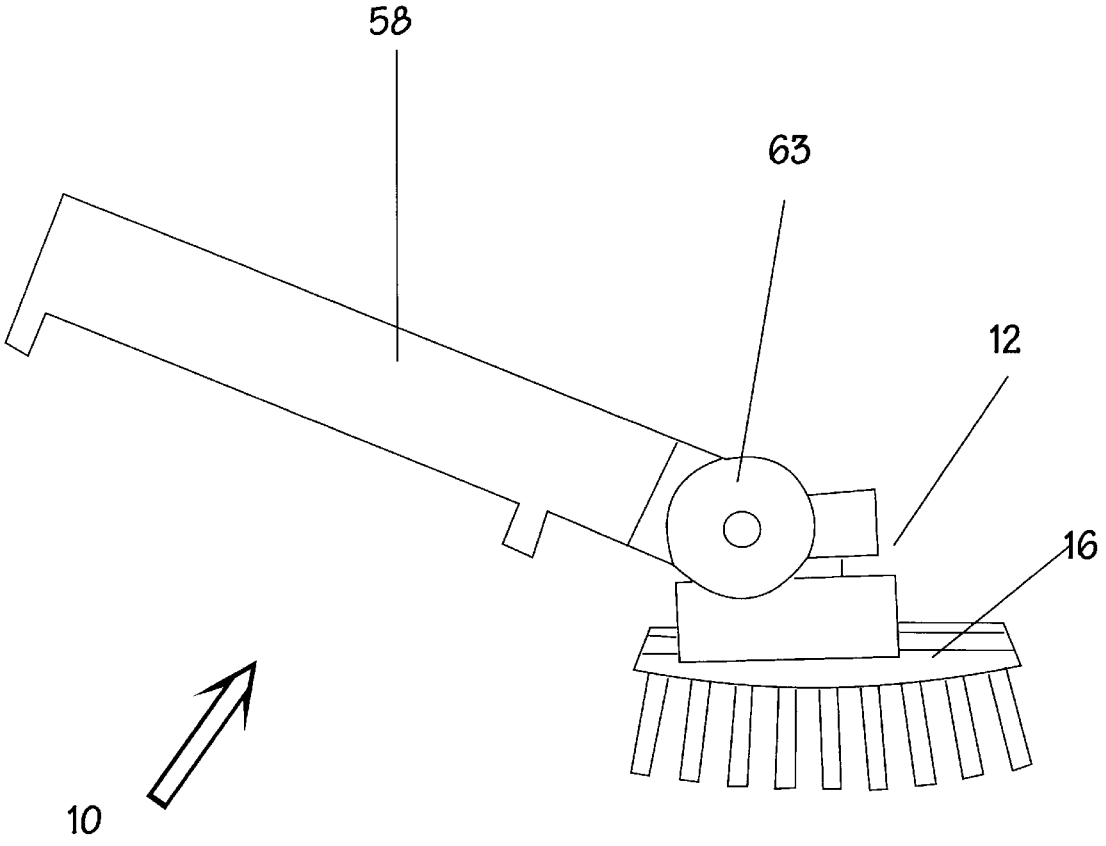
FIG. 5 is a pictorial view of the adjustable grout brush of the present invention, having a single brush mounting construction attached directly to a handling pole.

Additionally, where the use of a support track 14 is not desired, a single brush mounting construction 12 may be pivotally attached directly to the handling pole 58. The brush mounting constructions 12 each include an attachment bore 61 for this purpose. As shown with additional reference to FIG. 5, the brush mounting assembly may attached to the handling pole 58 via a threaded attachment bolt 63 passed through the pole and attachment bore 61. Attaching a single brush mounting construction 12 directly to the handling pole 58 yields a grout cleaning brush 10 that will fit into confined spaces without loss in cleaning ability.

It is also possible to form the brush 10 with brush mounting constructions 12 that a re permanently fixed in pre-set locations along the support track 14. With the brush mounting constructions 12 permanently fixed, the brush assemblies, themselves, 16 may still be removed and replaced as needed. In this manner, the brush mounting constructions 12 may be formed integral with, or fixedly attached to, the support track 14, while still allowing brush assembly 16 replacement. As a result, the brush 10 still allows swapping of brush assemblies 16, so that bristle 41 density may be matched with grout line thickness. Additionally, brush assemblies 16 with worn bristles may still be replaced, as needed.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. An adjustable brush for cleaning grout, said brush comprising:

an elongated support track;

a plurality of brush mounting constructions adapted to be slidably disposed on said support track, each construction having positioning means for selectively maintaining said construction along the longitudinal axis of said support track, said support track including at least one positioning recess disposed therein, said positioning means including a recess-engaging member adjustable disposed within said brush mounting construction; and a biasing member for forcibly positioning said recess-engaging member against said support track, with said support track being adapted to receive said recess-engaging members;

a plurality of brush assemblies adapted to be secured to said plurality of brush mounting constructions; and an articulating member extending from said support track, whereby said brush mounting constructions may be slid along said longitudinal axis of said support track.

2. The brush of claim 1, wherein:

said recess-engaging member is a spherical member; and said biasing member is a spring disposed within said brush mounting construction.

3. The brush of claim 1, wherein:

said brush assemblies are adapted to be removably attached to said brush mounting constructions.

4. The brush of claim 3, wherein:

said brush assemblies are slidably disposed on said brush mounting constructions.

5. The brush of claim 4, further including:

locking means for selectively preventing relative motion between said brush assemblies and said brush mounting constructions.

6. The brush of claim 5, wherein said locking means includes:

at least one recess disposed within an exterior surface of said brush assemblies;

a recess-engaging member adjustably disposed within each of said brush mounting constructions; and a plurality of biasing members for forcibly positioning each said recess-engaging member into a corresponding brush assembly recess, whereby said at least one recess provides at least one preferred location for said brush assemblies.

7. The brush of claim 6, wherein:

said support track includes a main panel having a channel disposed therealong, whereby said positioning means biasing members forcibly position said positioning means recess-engaging members into said channel, thereby promoting frictional, engagement between said brush mounting construction recess-engaging members and said support track.

8. The brush of claim 6, wherein:

said support track includes a main panel having a plurality of recessed cavities disposed therealong, whereby said positioning means biasing members forcibly position said positioning means recess-engaging members into said cavities, thereby promoting frictional engagement between said brush mounting construction recess-engaging members and said support track.

9. The brush of claim 5, wherein said locking means includes:

at least one recess disposed within an exterior surface of said brush mounting constructions;

at least one recess-engaging member adjustably disposed within said brush assemblies; and a plurality of biasing members for forcibly positioning each said recess-engaging member into a corresponding brush assembly recess, whereby said at least one recess provides at least one preferred location for said brush assemblies.

10. The brush of claim 9, wherein:

said support track includes a main panel having a channel disposed therealong, whereby said positioning means biasing members forcibly position said positioning means recess-engaging members into said channel, thereby promoting frictional engagement between said brush mounting construction recess-engaging members and said support track.

11. The brush of claim 9, wherein:

said support track includes a main panel having a plurality of recessed cavities disposed therealong, whereby said positioning means biasing members forcibly position said positioning means recess-engaging members into said cavities, thereby promoting frictional engagement between said brush mounting construction recess-engaging members and said support track.

12. An adjustable brush for cleaning grout, said brush comprising:

an elongated support track;

a plurality of brush mounting constructions adapted to be slidably disposed on said support track, each construction having positioning means for selectively maintaining said construction along the longitudinal axis of said support track, said positioning means including at least one elongated fastening member extending from said brush mounting constructions; and said support track includes a plurality of attachment apertures cut therethrough, said apertures sized to engage said at least one fastening member;

a plurality of brush assemblies adapted to be secured to said plurality of brush mounting constructions, said brush assemblies being slidably disposed on said brush mounting constructions, said brush assemblies being secured by locking means for selectively preventing relative motion between said brush assemblies and said brush mounting constructions; and an articulating member extending from said support track, whereby said brush mounting constructions may be selectively maintained at a plurality of preferred locations along said longitudinal axis of said support track, said locations corresponding to said attachment apertures.

13. An adjustable brush for cleaning grout, said brush comprising:

a support track;

a plurality of brush mounting constructions fixedly attached to said support track;

a plurality of brush assemblies adapted to be secured to said plurality of brush mounting constructions, said brush assemblies being adapted to be removably attached to said brush mounting constructions, said brush assemblies being slidably disposed on said brush mounting constructions;

locking means for selectively preventing relative motion between said brush assemblies and said brush mounting constructions; and an articulating member extending from said support track.

14. The brush of claim 13, wherein said locking means includes:

at least one recess disposed within an exterior surface of said brush assemblies;

a recess-engaging member adjustably disposed within each of said brush mounting constructions; and a plurality of biasing members for forcibly positioning each said recess-engaging member into a corresponding brush assembly recess, whereby said at least one recess provides at least one preferred location for said brush assemblies.

* * * * *